United States Patent [19]

Kusumoto

[11] Patent Number: 5,038,173

[45] Date of Patent: Aug. 6, 1991

[54] REPLACEABLE UNIT DETERMINATION MECHANISM

[75] Inventor: Hiroshi Kusumoto, Tokyo, Japan

[73] Assignee: Ricoh Company, Ltd., Tokyo, Japan

[21] Appl. No.: 525,538

[22] Filed: May 18, 1990

[30] Foreign Application Priority Data

May 19, 1989 [JP] Japan ..... 1-126156

[51] Int. Cl.[5] ..... G03G 15/00

[52] U.S. Cl. ..... 355/211; 355/200; 355/245; 355/282; 355/296

[58] Field of Search ..... 355/211, 200, 245, 296, 355/282, 212, 209, 210, 208, 204

[56] References Cited

U.S. PATENT DOCUMENTS

| | | | |
|---|---|---|---|
| 4,344,700 | 8/1982 | Kasama et al. | 355/211 |
| 4,551,000 | 11/1985 | Kanemitsu et al. | 355/210 |
| 4,585,327 | 4/1986 | Suzuki | 355/211 |
| 4,851,875 | 7/1989 | Tanimoto | 355/211 X |
| 4,899,197 | 2/1990 | Davis et al. | 355/282 X |

FOREIGN PATENT DOCUMENTS

| | | | |
|---|---|---|---|
| 0083570 | 4/1986 | Japan | 355/200 |

*Primary Examiner*—A. T. Grimley
*Assistant Examiner*—Robert Beatty
*Attorney, Agent, or Firm*—Cooper & Dunham

[57] ABSTRACT

A replaceable unit determination mechanism includes a detection mechanism which has a lever member which is arranged so that the lever member comes into contact with a claw-shaped member when a rotatable member is rotating. The detection mechanism generates a detection signal when the replaceable unit is placed at a predetermined position and stops generating the detection signal when the lever member comes into contact with the claw-shaped member after the replaceable unit is placed in the predetermined position. The determination mechanism also includes a determination part which determines that the replaceable unit is correctly placed in the predetermined position when the detection signal is supplied from the detection mechanism and which determines that the replaceable unit is a new replaceable unit when the detection mechanism stops generating the detection signal. The claw-shaped member is broken when the claw-shaped member comes into contact with the lever member of the detection mechanism.

17 Claims, 9 Drawing Sheets

REPLACEABLE UNIT DETERMINATION MECHANISM

BACKGROUND OF THE INVENTION

The present invention generally relates to an electrophotographic apparatus, and more particularly to an electrophotographic apparatus which uses an electrophotographic process, such as a laser beam printer, a laser beam copying machine or a laser beam facsimile machine. More particularly, the pesent invention is directed to a replaceable unit determination mechanism capable of determining whether or not a replaceable unit is placed in position and determining whether or not the replaceable unit is a new one.

An electrophotographic apparatus includes a photosensitive member, a developer, a cleaning device and a fixing device. There is a need to replace these elements at regular intervals with new ones. Conventionally, the elements are formed as replaceable "units". There is a possibility that the electrophotographic apparatus is mistakenly driven without placing a unit in position. In this case, toner particles may be scattered in the apparatus, or paper may be transported out of position. There is also a possibility that a used unit is mistakenly placed in position instead of placing a new unit.

SUMMARY OF THE INVENTION

It is a general object of the present invention to provide a new and novel replaceable unit determination mechanism in which the above-mentioned disadvantages are eliminated.

A more specific object of the present invention is to provide a replaceable unit determination mechanism which is suitable for an electrophotographic apparatus and which has the function of determining whether or not a unit is placed in position and/or the function of determining whether or not a unit placed in position is a new one.

The above-mentioned objects of the present invention are achieved by a replaceable unit determination mechanism, comprising:

a stationary frame;

a replaceable unit which is replaceably placed at a predetermined position, the replaceable unit including a rotatable member which is rotatably supported on the stationary frame, the rotatable member having a claw-shaped member;

sensor means, provided on the stationary frame and having a lever member which is arranged so that the lever member comes into contact with the claw-shaped member when the rotatable member is rotating, for generating a detection signal when the replaceable unit is placed at the predetermined position and for stopping generating the detection signal when the lever member comes into contact with the claw-shaped member after the replaceable unit is placed in the predetermined position; and determination means, coupled to the sensor means, for determining that the replaceable unit is correctly placed in the predetermined position when the detection signal is supplied from the sensor means and for determining that the replaceable unit is a new replaceable unit when the sensor means stops generating the detection signal, the claw-shaped member being broken when the claw-shaped member comes into contact with the lever member of the sensor means.

BRIEF DESCRIPTION OF THE DRAWINGS

The other objects, features and advantages of the present invention will become apparent from the following detailed description when read in conjunction with the accompnying drawings, in which.

DESCRIPTION OF THE PREFERRED EMBODIMENTS

A description will now be given of an electrophotographic apparatus according to a preferred embodiment of the present invention.

Figure 1:
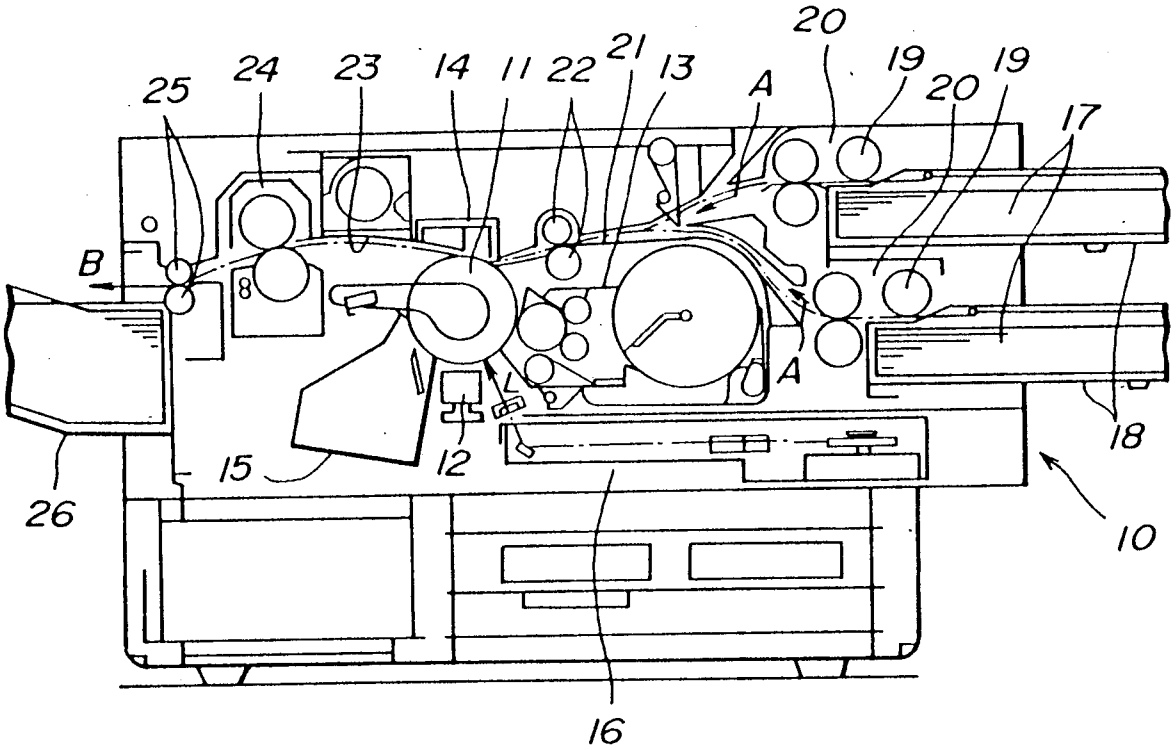
FIG. 1 is a diagram illustrating the entire structure of an electrophotographic apparatus according to a preferred embodiment of the present invention.

Referring to FIG. 1, there is illustrated the entire internal structure of an electrophotographic apparatus 10 according to the preferred embodiment of the present invention. The electrophotographic apparatus 10 comprises a photosensitive drum 11. Around the photosensitive drum 11, there are arranged a corona charger 12, a developer 13, a transfer/detach charger 14 and a cleaning device 15 in this order in the counterclockwise direction. A write unit 16 having optical elements such as a polygonal mirror and cylindrical lenses is provided under the developer 13. Two paper feed cassettes 18 for feeding paper 17 are provided on the right side of the electrophotographic apparatus 10. Paper feed mechanisms 20 having paper feed rollers 19 are provided for leading end portions of the paper feed cassettes 18. The paper feed mechanisms 20 are coupled to a pair of registration rollers 22 through a paper transport path 21. The pair of registration rollers 22 is located above the developer 13. A transport mechanism 23 and a fixing device 24 are arranged on the left side of the transfer/detach charger 14 opposite to the registration rollers 22. Paper eject rollers 25 are provided on the upstream side of the fixing device 24. A paper receiving tray 26 projecting from a housing of the electrophotographic apparatus 10 is provided at the end of the paper transport path.

Figure 2:
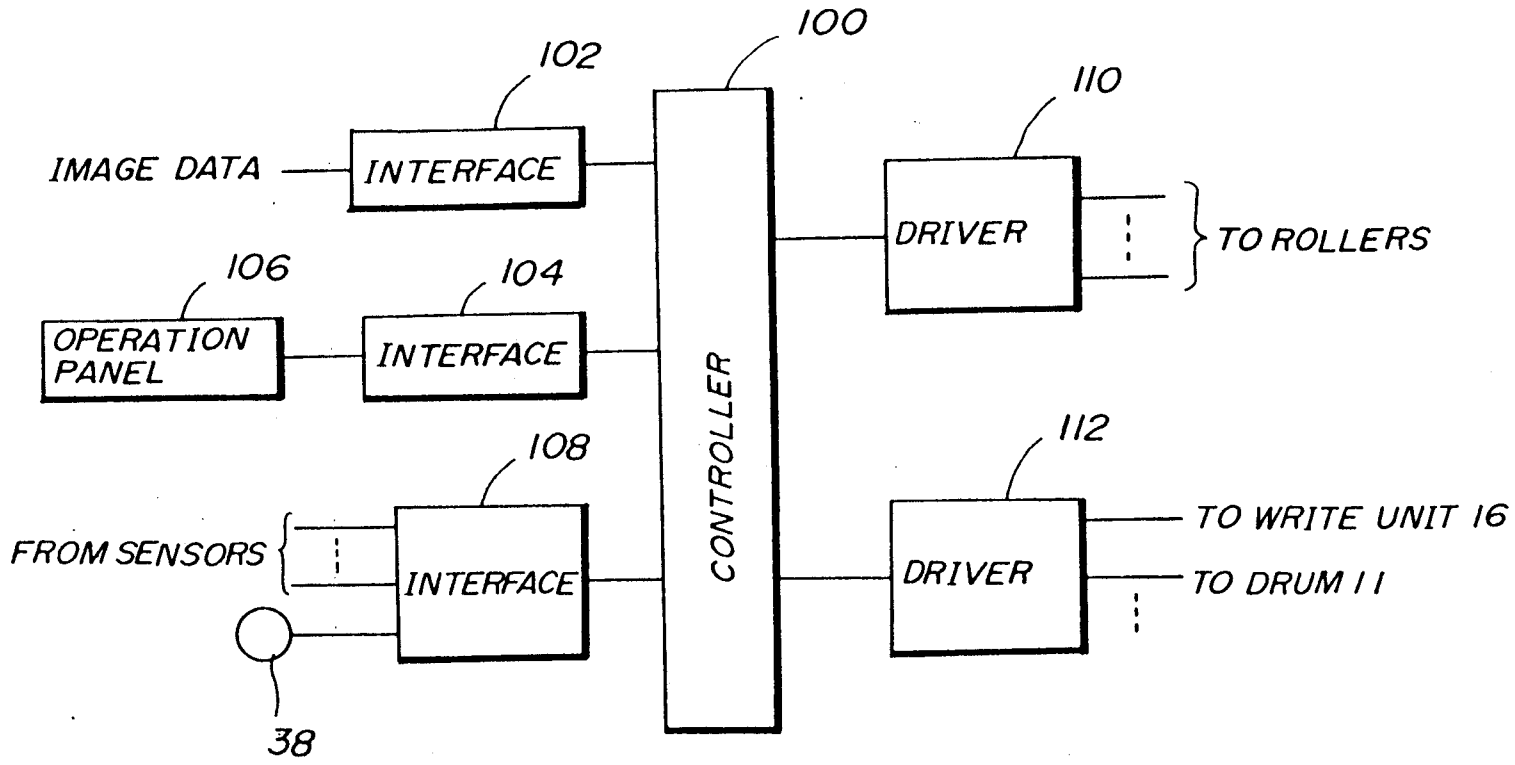
FIG. 2 is a block diagram of an electrical system provided in the electrophotographic apparatus shown in FIG. 1.

Referring to FIG. 2, there is illustrated an electical system provided in the electrophotographic apparatus 10. The electrical system includes a controller 100, interface circuits 102, 104 and 108, and drivers 110 and 112. Image data supplied from an external device, such as a host system, is supplied to the interface circuit 102, which has a memory used for temporarily storing the image data. The interface circuit 104 receives various instruction signals from an operation panel (not shown) provided on the housing of the electrophotographic apparatus 10. The interface circuit 108 receives various sense (detection) signals supplied from sensors provided in the electrophotographic apparatus 10. For example, the electrophotographic apparatus 10 has sensors for detecting positions of paper on the transport path. The interface also receives a detection signal supplied from a specific sensor 38 provided in a detection mechanism 36, which will be described in detail later. The controller 100 controls the entire operation of the electrophotographic apparatus 10. The driver 110 drives the rollers such as the registration rollers 110 in accordance with instruction signals from the controller 100. The driver 112 controls the write unit 16, the drum 11 and the other elements provided in the electrophotographic apparatus 10. For example, the driver 112 receives the image data from the interface circuit 102 under the control of the controller 110 and controls the write unit 16 so that a corresponding electrostatic latent image is formed on the photosensitive drum 11.

During printing, paper feed rollers 19 are driven and a sheet of paper is fed from one of the paper feed casettes 18 in the direction indicated by the arrow A. The paper 17 is transported on the paper transport path 21 until a position where a leading edge of the paper 17 comes into contact with the registration rollers 22. The photosensitive drum 11 is rotated in the counterclockwise direction. During one rotation of the photosensitive drum 11, the following operation is carried out. First, the surface of the photosensitive drum 11 is uniformly electrified by the corona charger 12. Next, a laser beam L emitted from the write unit 16 is projected onto the surface of the photosensitive drum 11 so that an electrostatic latent image is formed thereon. Then, the electrostatic laten image is changed to a visual image by supplying the drum 11 with toner particles by means of the eveloper 13. Then the paper 17 is transported toward the photosensitive drum 11 in synchronism with the rotation of the photosensitive drum 11. When the paper 17 passes on the photosensitive drum 11, the visual image formed on the surface of the photosensitive drum 11 is transferred on the paper 17. Then the paper 17 is detached electrostatically from the surface of the photosensitive drum 11 by the transfer/-detach charger 14. The surface of the photosensitive drum 11 is then cleaned by the cleaning device 15 so that toner particles left on the surface of the photosensitive drum 11 are eliminated therefrom. On the other hand, the paper 17 is transported to the fixing device 24 by the transport mechanism 23, which fixes the transferred image on the paper 17. After that, the paper 17 having the fixed image is transported in the direction indicated by the arrow B by the paper eject device 25, and is then supplied to the paper receiving tray 26.

Figure 3:
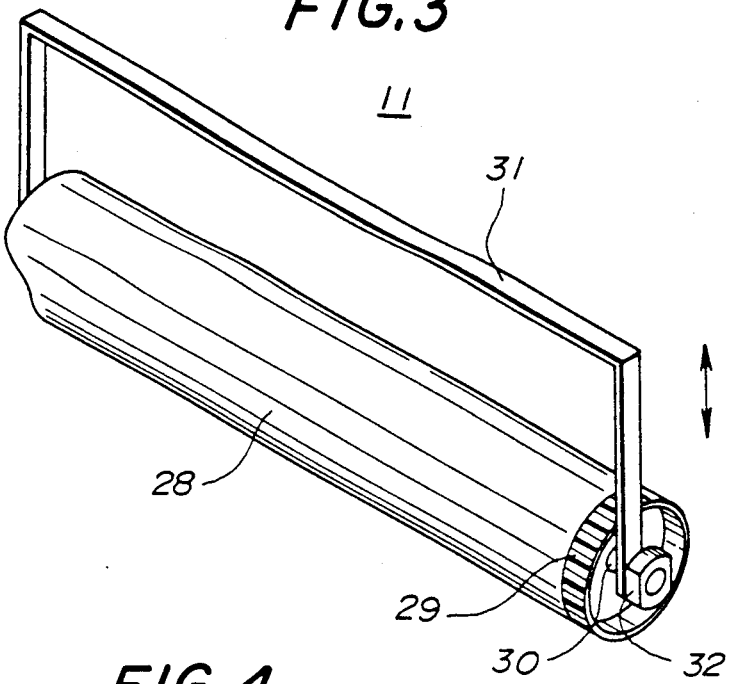
FIG. 3 is a perspective view of a photosensitive drum unit which is to be set in the apparatus shown in FIG. 1.
Figure 4:
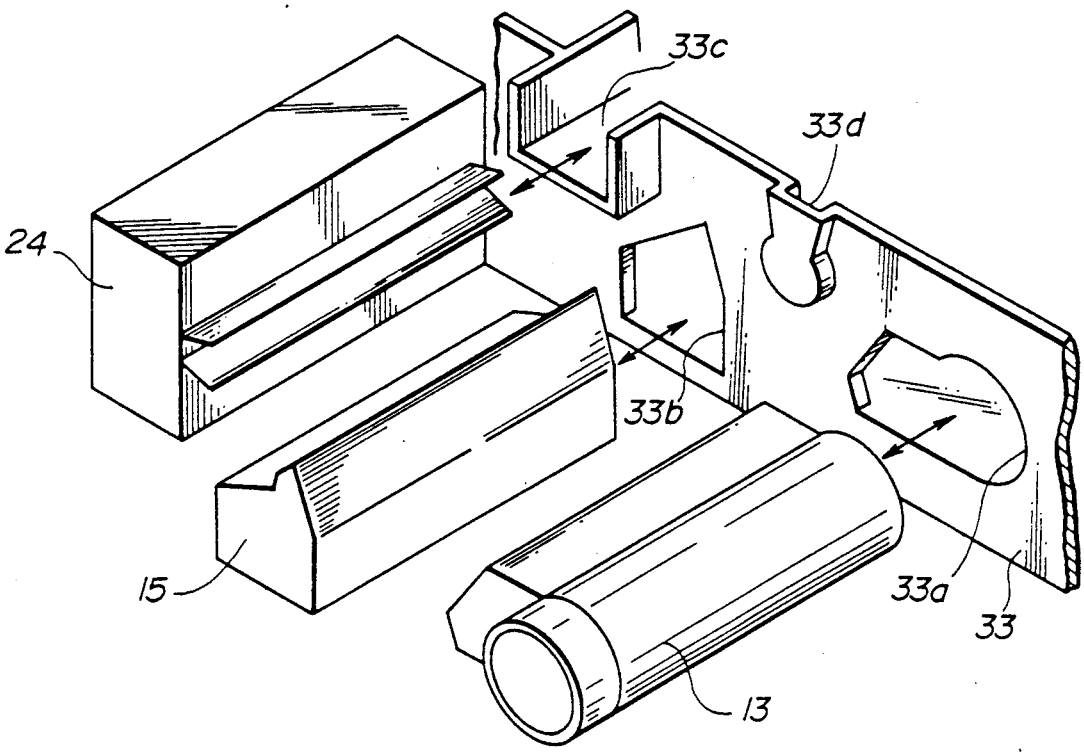
FIG. 4 is a perspective view illustrating how to set a developer unit, a cleaning unit and a fixing unit in the apparatus shown in FIG. 1.

Each of the photosensitive drum 11, the developer 13, the cleaning device 15 and the fixing device 24 is formed as a replaceable unit. As shown in FIG. 3, the unit of the photosensitive drum 11 (hereafter referred to as photosensitive drum unit 11) is composed of a photosensitive drum 28, a gear 29, a drum shaft 30 and a handle 31 having engagement members 32 (only one of which is shown). The gear 29 is provided on one end of the photosensitive drum 28. The drum shaft 30 longitudinally penetrates the center of the photosensitive drum 28. The handle 31 is rotatably provided on the both ends of the drum shaft 30. The engagement member 32 are provided outside of the ends of the drum shaft 30. The rotatable photosensitive drum unit 11 is placed in position from the upper side of the electrophotographic apparatus 10 as indicated by the arrow. In this state, an upper cover (not shown) is opened. The developer 13, cleaning unit 15 and the fixing unit 24 are respectively inserted into or taken out from the electrophotographic apparatus 10 through related cutout openings 33*a*, 33*b* and 33*c* formed in a frame 33 of a front cover of the electrophotographic apparatus 10, as indicated by the arrows (which coincide with the longitudinal direction of the photosensitive drum 28 (FIG. 3)). A portion 33*d* of the frame 33 is a concave engagement portion formed at an upper portion of the inner face of the frame 33. An identical concave engagement portion is formed in an inner surface of an opposite frame. The engagement members 32 of the photosensitive drum unit 11 shown in FIG. 3 are inserted into the concave engagement portions 33*d* so that the photosensitive drum unit 11 is bridged over the opposing frames.

Figure 5:
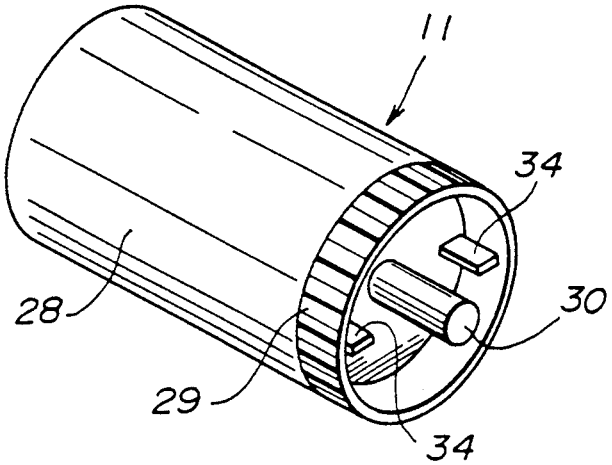
FIG. 5 is a perspective view of an essential part of the photosensitive drum unit which is to be set in the apparatus shown in FIG. 1.

As shown in FIG. 5, two claws 34 are provided on the end surface of the photosensitive drum 28 so that they are surrounded by the gear 29. The claws 34 project from the end surface of the photosensitive drum 28 in the longitudinal direction thereof. The drum shaft 30 is interposed between the two claws 34.

Figure 6:
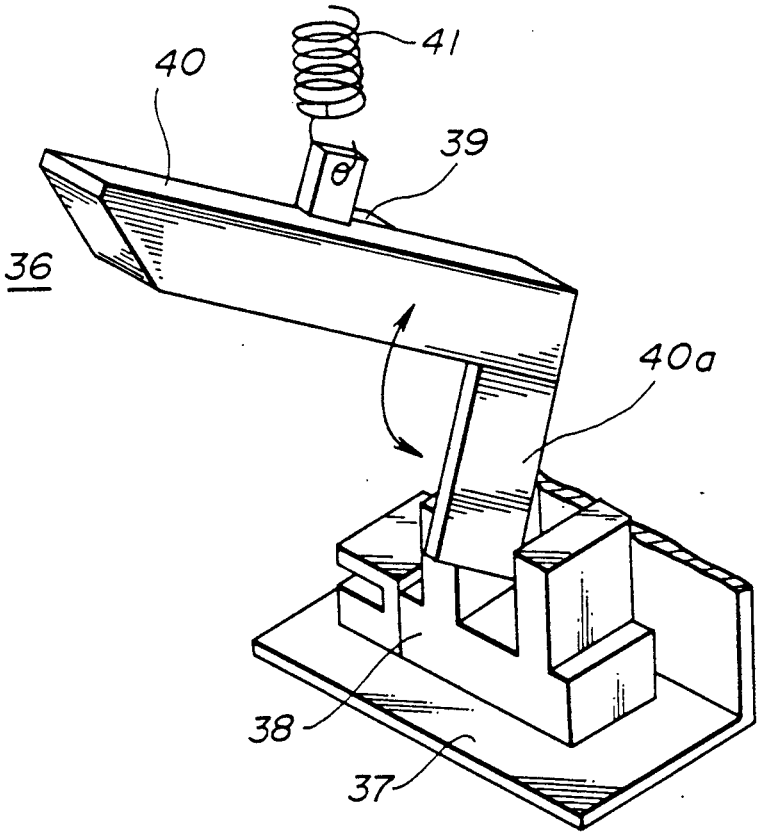
FIG. 6 is a perspective view of a detection mechanism related to the photosensitive drum unit shown in FIG. 5.

The detection mechanism 36 as shown in FIG. 6 is provided in the electrophotographic apparatus 10. The detection mechanism 36 is made up of a sensor 38, an actuating lever 40 and a coil spring 41. The sensor 38 is fixed to a part of the frame of the electrophotographic apparatus 10. The sensor 38 has two opposite projections, which are spaced apart from each other. A light-emitting element is provided on one of the projections and a light-receiving element is provided on the other projection. The light-emitting element is driven through the interface circuit 108, for example. The actuating lever 40 rotates around a shaft 39 fixed to the frame. The actuating lever 40 is urged in the clockwise direction by the coil spring 41 fixed to the frame. The actuating lever 40 has a filler portion 40*a*, which is separated, in a normal state, from the sensor 38 due to the function of the coil spring 41.

Figure 7:
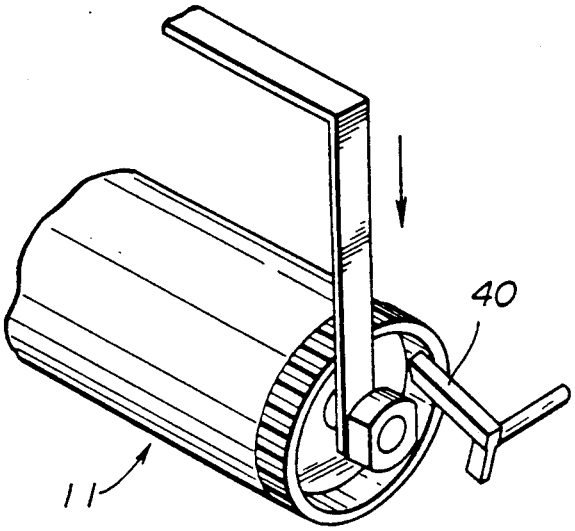
FIGS. 7 through 12 are perspective views illustrating how to set the photosensitive drum unit in the apparatus shown in FIG. 1.
Figure 8:
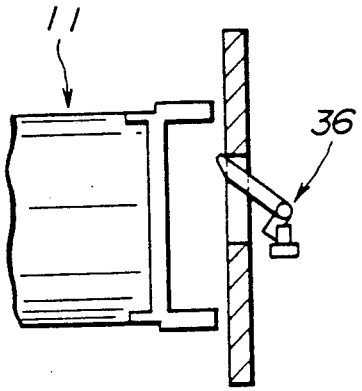

When replacing the photosensitive drum unit 11, the operator grips the handle 31 and lifts up the same. During this operation, the sensor 38 is OFF. The operator grips the handle 31 of a new photosensitive drum unit 11, and inserts the same into the electrophotographic apparatus 10, as shown by the arrow in FIG. 7. It will be noted that as shown in FIG. 8, the sensor 36 is still maintained at the OFF state by simply placing the new photosensitive drum unit 11 in position where the handle is upright. It will also be noted that there is no engagement between the handle 31 and the actuating lever 40.

Figure 9:
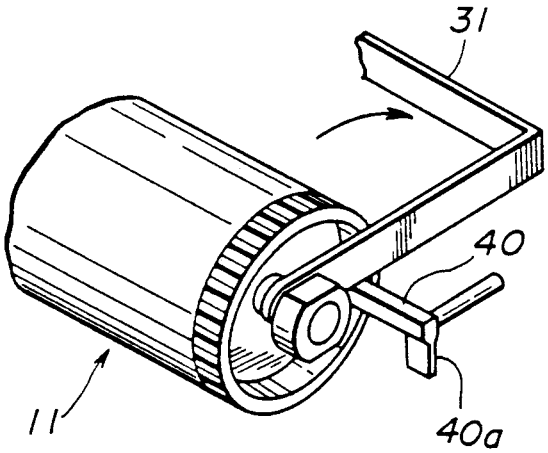
Figure 10:
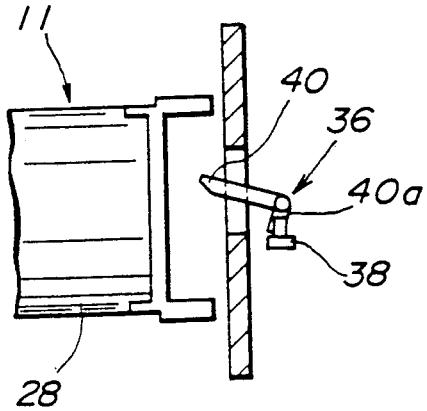

As shown in FIG. 9, the handle 31 is turned as indicated by the arrow shown therein so that the handle 31 extends horizontally. In this state, the setting of the photosensitive drum unit 11 is completed. When setting the handle 31 so as to extend horizontally, as shown in FIG. 10, the handle 31 rotates the actuating lever 40 against the force of the coil spring 41 (FIG. 6) so that the filler 40*a* is inserted into a space between the two projections of the sensor 38. In this state, the detection mechanism 36 is ON.

Figure 11:
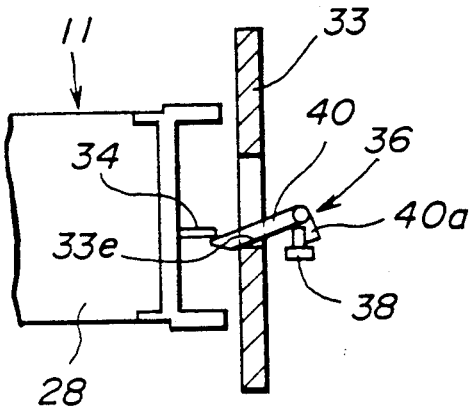
Figure 12:
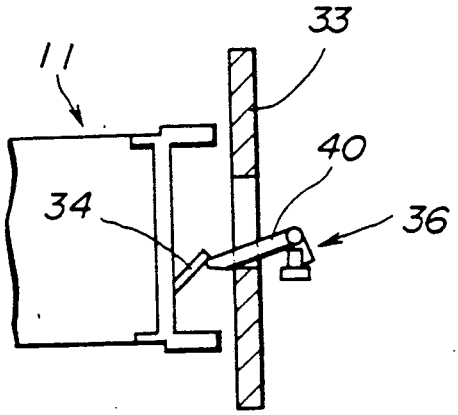

When recording information on the photosensitive drum 28, the photosensitive drum 28 is rotated. During the time when the photosensitive drum 28 is rotating, as shown in FIG. 11, one of the claws 34 comes into contact with the actuating lever 40. Then, the claw 34 being considered rotates the actuating lever 40 in the clockwise direction. Thereby, the filler portion 40*a* becomes separated from the sensor 38 so that the detection mechanism 36 is turned OFF. Then the actuating lever 40 comes into contact with an edge of the cutout opening 33*a*. The photosensitive drum 28 further rotates, and as shown in FIG. 12, the actuating lever 40 breaks the claw 34 so that the claw 34 falls down. Thereby, the actuating lever 40 becomes released from the engagement with the claw 34. Then the detection mechanism 36 is turned ON again. Although the photosensitive drum unit 11 has two claws 34, it is possible to provide the same with a single claw.

The controller 100 shown in FIG. 2 receives the detection signal from the sensor 38 of the detection mechanism 36 through the interface circuit 108. When a used photosensitive drum unit is set in the electrophotographic apparatus 10, there is no ON/OFF change in the detection signal from the sensor 38 because the used photosensitive drum unit has no claw. It should be appreciated that the claws 34 shown in FIG. 5 are surrounded by the gear 29 so that the claws 34 are prevented from being mistakenly broken during the setting operation.

Figure 13:
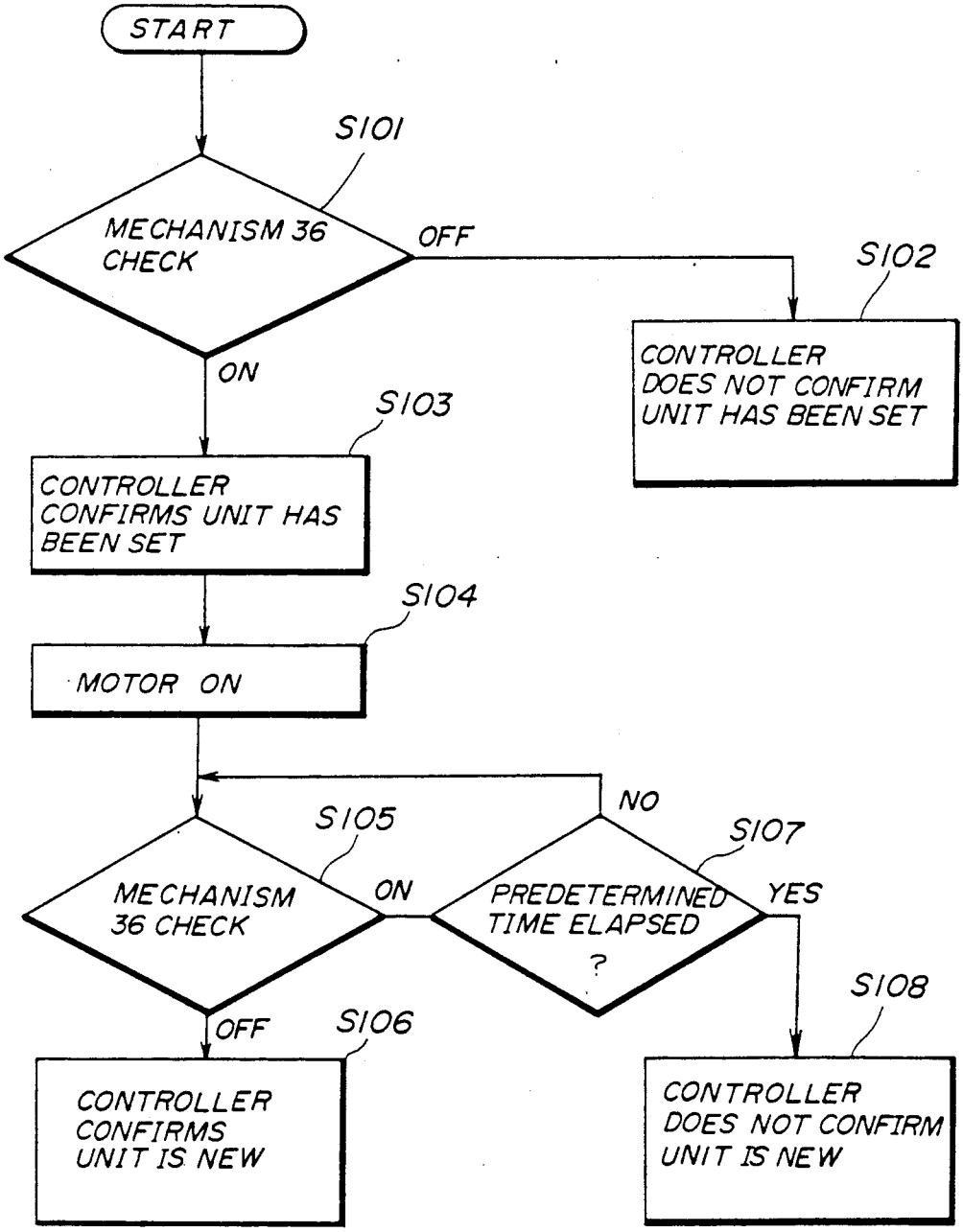
FIG. 13 is a flowchart of a detection procedure executed by a controller shown in FIG. 2.

The controller 100 executes a procedure shown in FIG. 13. At step S101, the controller 100 determines whether the detection mechanism 36 is ON or OFF. When it is determined that the detection mechanism 36 is OFF, at step S102, the controller 100 cannot determine that the photosensitive drum unit 11 has been accommodated in the predetermined position in the electrophotographic apparatus 10. On the other hand, when it is determined that the detection mechanism 36 is ON, at step S103, the controller 100 determines that the photosensitive drum unit 11 has been accommodated in the predetermined position. It will be noted that the handle 31 is turned so that it becomes horizontal and thereby the detection mechanism 36 becomes ON. At step S104 subsequent to step S103, the controller 100 turns ON a motor (not shown) for driving the photosensitive drum 28.

At step S105, the controller 100 determines whether or not the detection mechanism 36 is ON. When it is determined that the detection mechanism 36 is ON, at step S107, the controller 100 determines whether or not the photosensitive drum 28 has rotated by a predetermined amount, for example, one revolution or ½ revolution. When two claws are used, it is sufficient to determine whether or not the photosensitive drum 28 has been rotated by ½ revolution. On the other hand, when a single claw is used, it is sufficient to determine whether or not the photosensitive drum 28 has been rotated by one revolution. At step S107, the controller 100 counts the number of pulses which are to be supplied to the motor related to the photosensitive drum 28. The controller 100 compares the current number of pulses with a predetermined number of pulses amounting to one revolution. When the determination result obtained at step S107 is NO, the procedure returns to step S105. On the other hand, when the determination result obtained at step S107 is YES, the controller 100 determines that the photosensitive drum unit 11 being considered is not a new one. When it is determined that the detection mechanism 36 becomes OFF, the controller 100 determines that the photosensitive drum unit 11 being considered is a new one.

Figure 14:
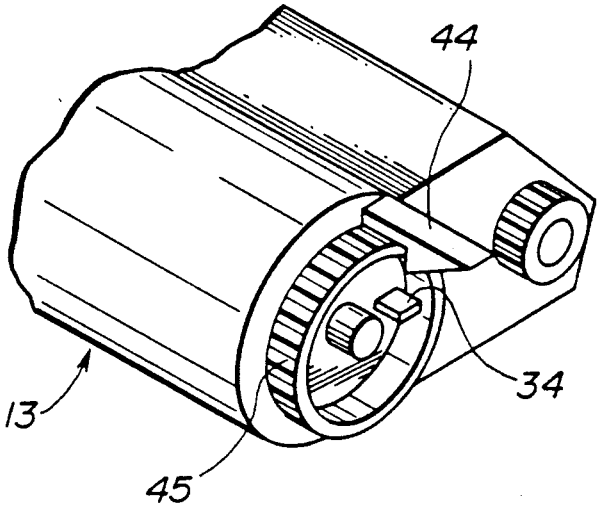
FIG. 14 is a perspective view of the developer unit which is to be set in the apparatus shown in FIG. 1.

FIG. 14 illustrates a detection mechanism provided for the developer unit 13. The developer unit 13 has a roller, a gear 45 provided on one end thereof and a claw 34 provided on an end surface of the developer unit 13 and surrounded by the gear 45. The developer unit 13 further includes an engagement projection 44 which is positioned so that it projects from the end surface of the developer unit 13 and engages with the claw 34. There is provided a mechanism which is the same as shown in FIG. 6 on the side of the frame of the electrophotographic apparatus 10.

Figure 15:
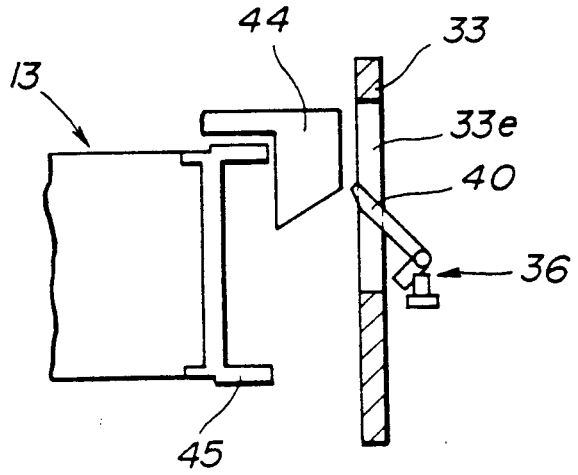
FIGS. 15 and 16 are diagrams illustrating how the detection mechanism related to the developer unit shown in FIG. 14 works.
Figure 16:
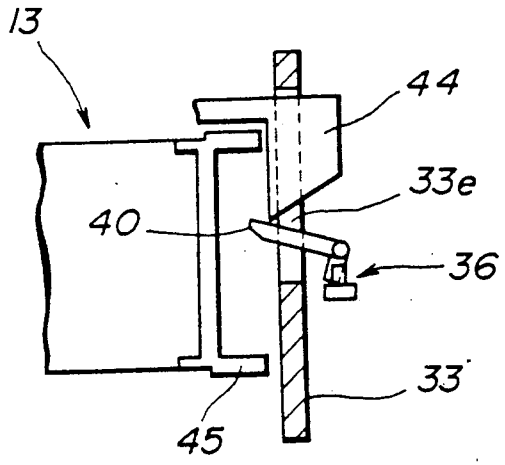

The developer unit 13 is inserted into the cutout opening 33*a* so that the claw 34 and the engagement projection 44 are opposite to the frame 33. As shown in FIGS. 15 and 16, during the time when the developer unit 13 is being inserted into the cutout opening 33*a*, the engagement projection 44 comes into contact with the actuating lever 40 and depresses the same. Thereby, the detection mechanism 36 is turned ON. It will be noted that an engagement surface of the projection is oblique with respect to the upright frame surface so that the engagement between the engagement projection 44 and the actuating lever 40 is facilitated. When the developer 13 starts to rotate, the claw 34 comes into contact with the actuating lever 40 and rotates the same so that the detection mechanism 36 is turned OFF. The actuating lever 40 comes into contact with the edge of the cutout opening 33*a*. The developer 13 further rotates, and the claw 34 which is in engagement with the actuating lever 40 is broken. As a result, the detection mechanism 36 is turned ON again. During the above-mentioned operation, the controller 100 (FIG. 2) executes the procedure shown in FIG. 13 so that it is determined whether or not the developer unit 13 has been correctly set in the predetermined position and whether or not the developer unit 13 being considered is a new one.

Figure 17:
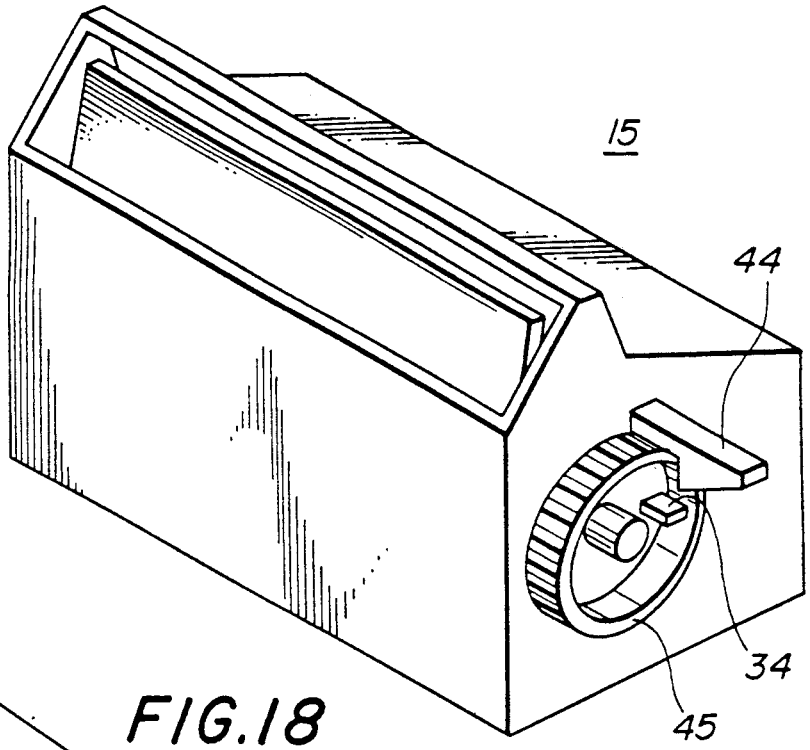
FIG. 17 is a perspective view of a cleaning unit which is to be set in the apparatus shown in FIG. 1.

FIG. 17 is a perspective view of the cleaning device 15. The cleaning unit 15 has a detection mechanism which is the same as shown in FIG. 14. The detection mechanism shown in FIG. 17 operates in the same way as that shown in FIG. 14 related to the developer unit 13.

Figure 18:
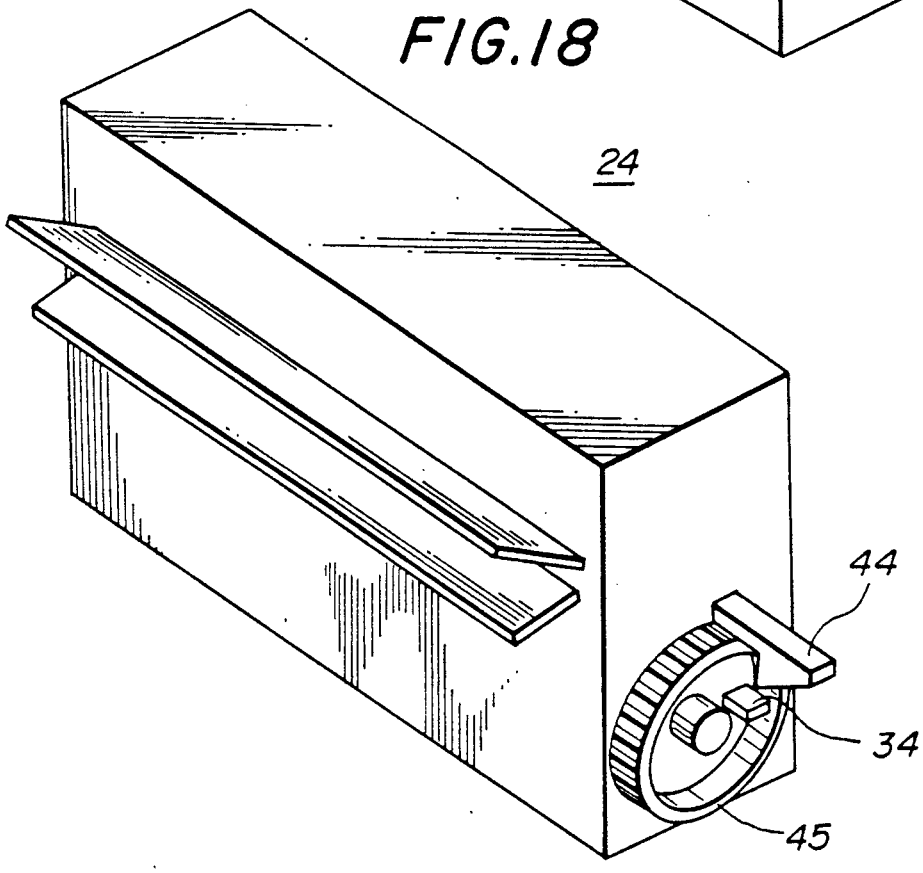
FIG. 18 is a perspective view of the fixing unit which is to be set in the apparatus shown in FIG. 1.

FIG. 18 is a perspective view of the fixing unit 24. The fixing unit 24 has a detection mechanism which is the same as shown in FIG. 14. The detection mechanism shown in FIG. 18 operates in the same way as that shown in FIG. 14.

The present invention is not limited to the specifically described embodiments, and variations and modifications may be made without departing from the scope of the present invention. For example, it is possible to provide a replaceable unit with a magnetic sensor. In this case, it is preferable that the actuating lever 40 is made of a magnetic material.

What is claimed is:

1. A replaceable unit determination mechanism comprising:

a stationary frame;

a replaceable unit which is replaceably placed at a predetermined position in said frame, said replaceable unit including a rotatable member which is rotatably supported on said stationary frame and which is rotated by a driving force externally applied thereto after said replaceable unit is placed at said predetermined position, said rotatable member having a first claw-shaped member;

sensor means, provided on said stationary frame and having a lever member which is arranged so that said lever member comes into contact with said first claw-shaped member when said rotatable member is rotating, for generating a detection signal when said replaceable unit is placed at said predetermined position and for stopping the generation of said detection signal when said lever member comes into contact with said first claw-shaped member after said replaceable unit is placed in said predetermined position and is rotated by said driving mechanism; and determination means, coupled to said sensor means, for determining that said replaceable unit is correctly placed in said predetermined position when said detection signal is supplied from said sensor means and for determining that said replaceable unit is a new replaceable unit when said sensor means stops the generation of said detection signal, said first claw-shaped member being broken when said first claw-shaped member comes into contact with said lever member of the sensor means.

2. A replaceable unit determination mechanism as claimed claim 1, wherein:

said lever member of the sensor means comprises a sensor which generates said detection signal when said lever member of the sensor means is located at a first position where said replaceable unit is placed at the predetermined position;

said lever member of the sensor means is shifted to a second position from said first position when said lever member of the sensor means comes into contact with said first claw-shaped member of the replaceable unit; and said sensor stops the generation of said detection signal when said lever member is shifted to said second position from said first position.

3. A replaceable unit determination mechanism as claimed in claim 2, wherein:

said sensor comprises a pair of light-emitting elements which emits a light and light-receiving elements which receives said light;

said lever member of said sensor means is located at said first position where said lever member is interposed between said light-emitting elements and said light-receiving elements so that said light from the light-emitting elements is interrupted by said lever member; and said lever member of said sensor means is located at said second position where said lever member permits said light from said light-emitting element to be received by said light-receiving element.

4. A replaceable unit determination mechanism as claimed in claim 2, wherein said stationary frame has a cutout opening into which said lever member of said sensor means is inserted and comes into contact with said first claw-shaped member of said replaceable unit.

5. A replaceable unit determination mechanism as claimed in claim 4, wherein said lever member of said sensor means comes into contact with an edge of said cutout opening when said lever member is located at said second position.

6. A replaceable unit determination mechanism as claimed in claim 2, wherein said sensor means comprises means for urging said lever member of said sensor means toward an initial position.

7. A replaceable unit determination mechanism, comprising:

a stationary frame;

a replaceable unit which is replaceably placed at a predetermined position in said frame, said replaceable unit including a rotatable member which is rotatably supported on said stationary frame, said rotatable member having a claw-shaped member;

sensor means, provided on said stationary frame and having a lever member which is arranged so that said lever member comes into contact with said claw-shaped member when said rotatable member is rotating, for generating a detection signal when said replaceable unit is placed at said predetermined position and for stopping the generation of said detection signal when said lever member comes into contact with said claw-shaped member after said replaceable unit is placed in said predetermined position; and determination means, coupled to said sensor means, for determining that said replaceable unit is correctly placed in said predetermined position when said detection signal is supplied from said sensor means and for determining that said replaceable unit is a new replaceable unit when said sensor means stops the generation of said detection signal, wherein:

said claw-shaped member is broken when said claw-shaped member comes into contact with said lever member of the sensor means;

said lever member of the sensor means comprises a sensor which generates said detection signal when said lever member of the sensor means is located at a first position where said replaceable unit is placed at the predetermined position;

said lever member of the sensor means is shifted to a second position from said first position when said lever member of the sensor means comes into contact with said claw-shaped member of the replaceable unit;

said sensor stops the generation of said detection signal when said lever member is shifted to said second position from said first position;

said sensor means comprises means for urging said lever member of said sensor means toward an initial position; and said replaceable unit has an engagement member which comes into contact with said lever member of said sensor means against a force provided by said means for urging when said replaceable unit is placed at said predetermined position so that said lever member is located at said first position.

8. A replaceable unit determination mechanism as claimed in claim 6, wherein said means for urging comprises a coil spring having a first end fixed to said stationary frame and a second end fixed to said lever member.

9. A replaceable unit determination mechanism as claimed in claim 7, wherein said engagement member of said replaceable unit includes a handle which is rotatably provided for said replaceable unit.

10. A replaceable unit determination mechanism as claimed in claim 9, wherein said handle extends horizontally and is in contact with said lever member of said sensor means when said replaceable unit is placed at said predetemined position.

11. A replaceable unit determination mechanism as claimed in claim 7, wherein said engagement member of said replaceable unit comprises a projection member which is fixed to said replaceable unit and which projects from a side surface of said replaceable unit.

12. A replaceable unit determination mechanism as claimed in claim 1, wherein:

said replaceable unit has a second claw-shaped member in addition to said first claw-shaped member;

said first claw-shaped member and said second claw-shaped member are aligned on an end surface of said rotatable member of said replaceable unit; and said end surface of said rotatable member is opposite to said sensor means.

13. A replaceable unit determination mechanism as claimed in claim 1, wherein said determination means determines that said replaceable unit is a new replaceable unit when said sensor means stops the generation of said detection signal during one revolution of said rotatable member.

14. A replaceable unit determination mechanism as claimed in claim 1, wherein said replaceable unit is a photosensitive drum unit having a photosensitive drum provided in an electrophotographic apparatus.

15. A replaceable unit determination mechanism as claimed in claim 1, wherein said replaceable unit is a developer unit having a drum-shaped developing roller provided in an electrophotographic apparatus.

16. A replaceable unit determination mechanism as claimed in claim 1, wherein said replaceable unit is a cleaning unit having a drum-shaped cleaning roller provided in an electrophotographic apparatus.

17. A replaceable unit determination mechanism as claimed in claim 1, wherein said replaceable unit is a fixing unit having a drum-shaped fixing roller provided in an electrophotographic apparatus.

* * * * *